US005461829A

United States Patent [19]

Lehto et al.

[11] Patent Number: 5,461,829

[45] Date of Patent: Oct. 31, 1995

[54] TROLLEY RAIL SYSTEM FOR SLIDING DOOR

[75] Inventors: Eino M. Lehto; Burl Finkelstein, both of Newnan, Ga.

[73] Assignee: Kason Industries, Inc., Shenandoah, Ga.

[21] Appl. No.: 297,167

[22] Filed: Aug. 29, 1994

[51] Int. Cl.[6] ..... E05D 15/06

[52] U.S. Cl. ..... 49/409; 16/87 R; 16/96 R; 49/225; 49/235

[58] Field of Search ..... 49/409, 410, 411, 49/213, 225, 235, 506; 16/94 R, 96 R, 93 R, 87 R, 87.8

[56] References Cited

U.S. PATENT DOCUMENTS 4,404,770 9/1983 Markus ..... 49/409
4,619,075 10/1986 Wiles ..... 49/410 X
4,651,469 3/1987 Ngian et al. ..... 49/409 X
4,680,828 7/1987 Cook et al. ..... 49/235 X
5,165,142 11/1992 Pilsbury ..... 49/409 X

*Primary Examiner*—Philip C. Kannan
*Attorney, Agent, or Firm*—Kennedy & Kennedy

[57] ABSTRACT

A trolley rail system (10) for supporting and guiding a sliding cooler door (14) of a walk-in type cooler. The system has a guide rail (27) having two linear segments (29,30) and two deviation ramp portions (33,34), and an auxiliary rail (38). The system also has a leading trolley (41) and a trailing trolley (42). The leading trolley has a wheel (51) supported upon the guide rail. The trailing trolley has a primary wheel (52) supportable upon the guide rail and an auxiliary wheel (53) supportable upon the auxiliary rail.

11 Claims, 3 Drawing Sheets

TROLLEY RAIL SYSTEM FOR SLIDING DOOR

TECHNICAL FIELD

This invention relates to trolley rail systems for use in supporting and guiding sliding doors between closed and open positions.

BACKGROUND OF THE INVENTION

Large walk-in type coolers, such as those commonly found in refrigerated warehouses, are typically constructed with door openings sized to accommodate dollies and fork-lifts. These coolers have large insulated doors which are suspended from guide rails mounted above the door openings by a pair of trolleys mounted to the top of the door adjacent its sides. The trolleys guide the doors beneath the rails in a sideways direction and thus are referred to as sliding doors.

To insure a tight seal between the cooler door and door jamb, and between the cooler door and the underlying floor, resilient, sealing strips are provided therebetween. However, were the door to be slid across rather than brought into abutment with the sealing strips, the strips would quickly wear. To avoid this substantial sliding contact with the sealing strips, the cooler door is guided away from the door jambs and upward from the floor upon initial opening, and vice versa upon final closing. This is accomplished by providing the guide rail with deviation ramp portions which simultaneously direct the trolleys thereon, and hence the door, in these directions. However, a problem with these ramps has been that the trailing trolley, i.e. the trolley adjacent the trailing edge of the door as it is slid open, has passed over and therefore rode down the deviation rail ramp portion which directs the leading trolley for sealing and unsealing as the door is slid closed and open. This may cause the bottom trailing corner of the door to strike the floor and place substantial stress upon the system at this point.

To prevent the just described problem from occurring the trolleys have had to be mounted outboard of the door so that they do not reach the deviation rail portion for the leading trolley during door travel. This however in turn requires that the rail extend beyond the door jamb. Also, this is not feasible with coolers having double doors which slide into abutment with each other upon closing since such outboard trolleys would make contact with each other prior to the doors moving into mutual abutment.

It thus is seen that a need remains for a trolley rail system having guide ramps for supporting and guiding a sliding door between a closed position and an open position without causing wear to sealing strips and which does not require the use of outboard trolleys. Accordingly, it is to the provision of such that the present invention is primarily directed.

SUMMARY OF THE INVENTION

In a preferred form of the invention, a trolley rail system is provided for supporting and guiding a sliding door between closed and open positions. The trolley rail system comprises a primary rail having two linear portions and two deviation portions adapted to be mounted above a door opening. An auxiliary rail is provided to be also mounted above the door opening parallel with the primary rail and adjacent to one of the deviation portions. Two trolleys are mounted to the door with each trolley having a primary wheel and with their primary wheels spaced apart a distance that substantially matches the distance between the two deviations in the primary rail. One of the trolleys also has an auxiliary wheel that is axially spaced from its primary wheel a distance for movement on the auxiliary rail as its primary wheel traverses in the vicinity of one of the primary rail deviation portions to elevate and prevent its primary wheel from rolling along the primary rail deviation portion.

In use the primary wheel of the two trolleys are moved along linear portions of the primary rail. The door is moved along a limited plane of travel. As they simultaneously move into the deviation portions the door is moved outside the limited plane into sealing engagement with ancillary structures. However as the door is opened the primary wheel of the trailing trolley is prevented from rolling into the deviation portion provided for that of the leading trolley by the auxiliary wheel then riding on the ancillary rail.

DETAILED DESCRIPTION

Figure 1:
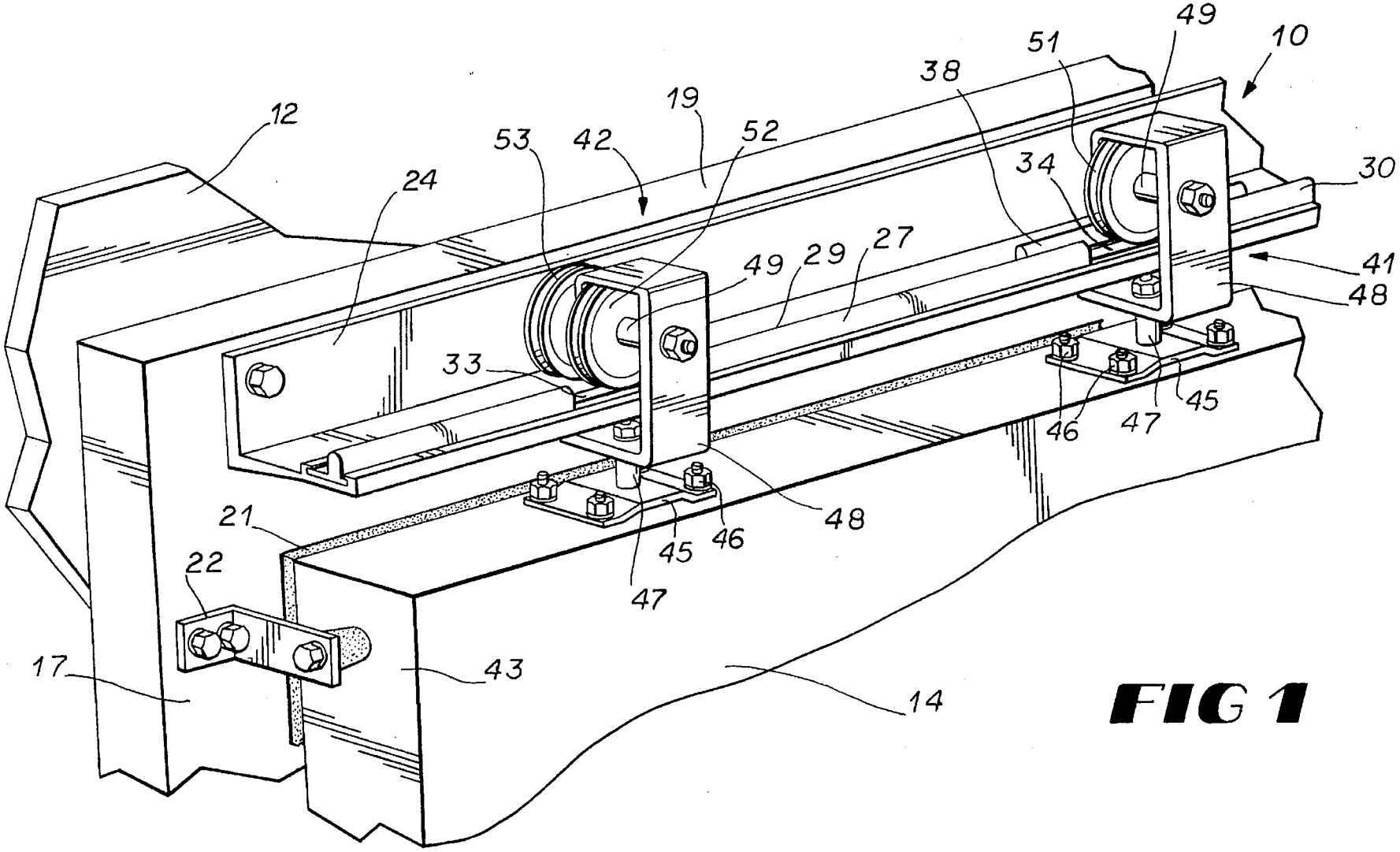
FIG. 1 is a perspective view of a portion of a trolley rail system made in accordance with principles of the invention in a preferred form shown mounted to a portion of a cooler and cooler door in a closed configuration.

With reference next to the drawings, there is shown a trolley rail system 10 of the present invention shown mounted to a walk-in type cooler having a cooler wall 12 with a door opening or doorway 13 therethrough and an insulated cooler door 14. The door opening 13 is framed by a door jamb 16 having a side-piece 17, another unshown side-piece opposite side-piece 17, and a header 19 spanning the side-pieces. A thermal sealing strip 21 and door stop 22 are mounted to the outside of the door jamb 16. An unshown thermal sealing strip is also mounted to the bottom of the cooler door 14.

Figure 3:
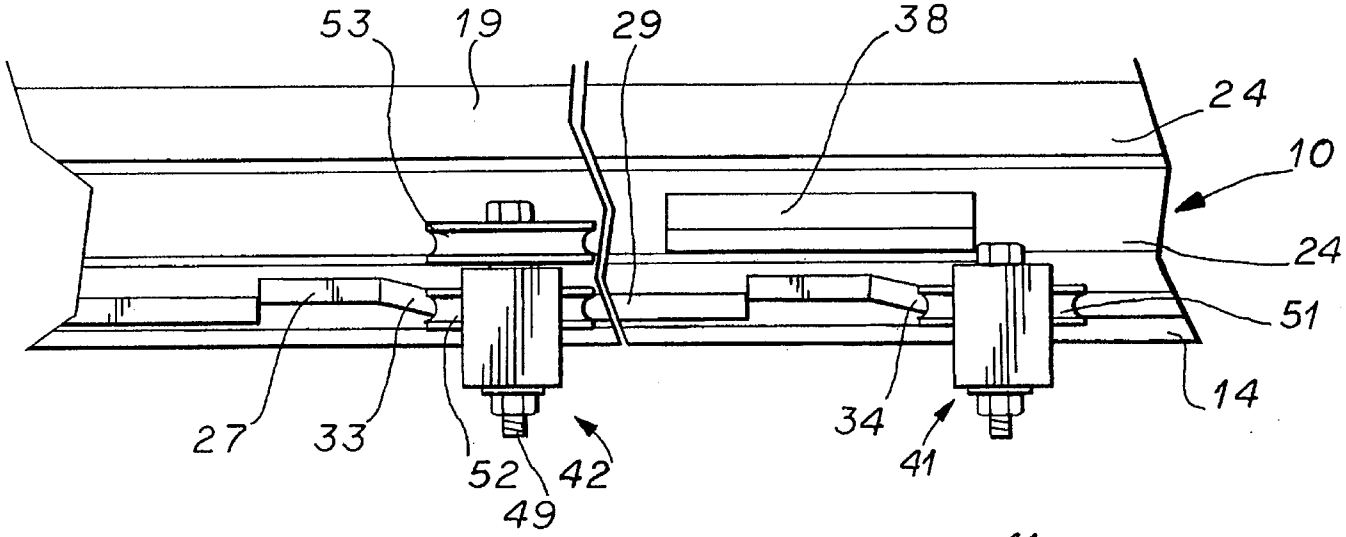
FIG. 3 is a top view of the trolley rail system of FIG. 1.
Figure 4:
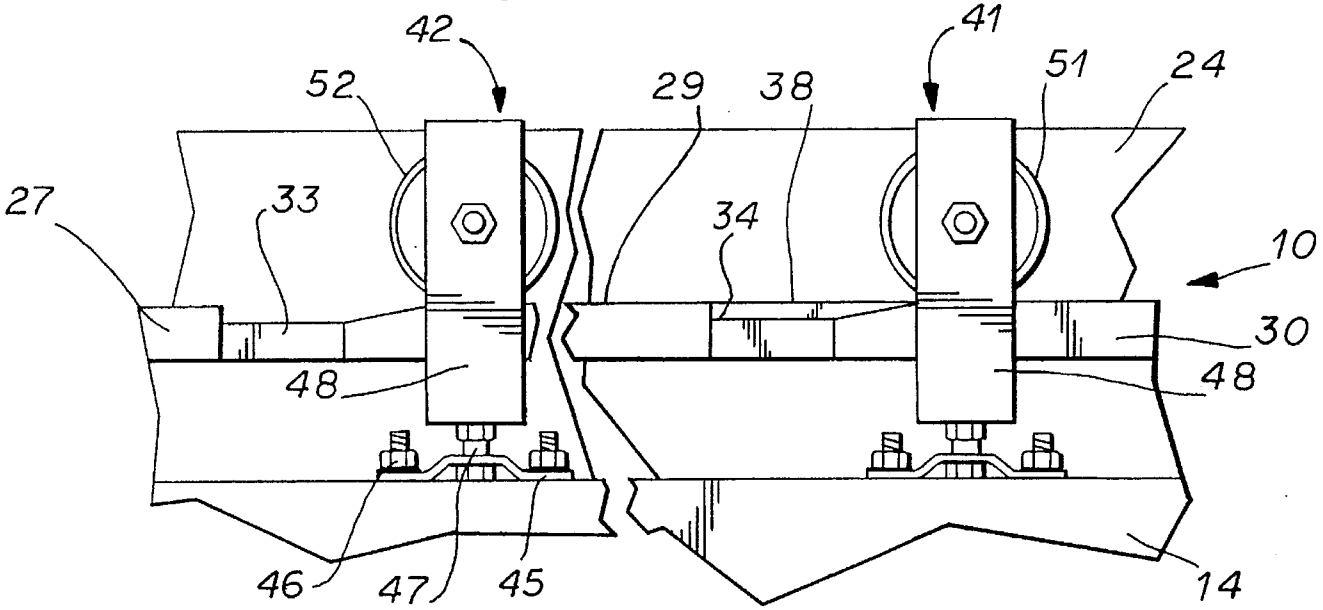
FIG. 4 is a side elevational view of the trolley rail system of FIG. 1.

The system 10 has an L-shaped support 24 mounted to the header 19 and secured thereto by bolts 25. Support 24 has a U-shaped channel in which is mounted an elongated guide rail 27. The guide rail 27 has two linearly aligned linear segments 29 and 30 which extend generally parallel to the cooler wall 12. The guide rail also has a deviation or jog ramp portion 33 which merges with segment 29, and a deviation or jog ramp portion 34 which merges with segments 29 and 30. The ramp portions 33 and 34 both deviate from the horizontal, linear segments by inclining downward therefrom and towards the header 19, as shown in FIGS. 3 and 4. An auxiliary rail 38 is mounted to the support 24 generally parallel to guide rail 27 and adjacent ramp portion 34.

A lead trolley 41 is mounted to the top of the cooler door 14 adjacent and inboard to a leading side of the door with respect to the direction of door movement upon opening. A trailing trolley 42 is mounted to the top of the cooler door adjacent and inboard of the trailing side of the door, also with respect to the direction of door movement upon opening. The lead trolley 41 and the trailing trolley 42 each has an H-shaped mounting bracket 45 secured to the top of the door by four bolts 46, an upright axle 47 rotatably coupled at one end to the mounting bracket 45, a roller bracket 48 mounted to the opposite end of the upright axle 47, and a horizontal axle 49 mounted to roller bracket 48. The horizontal axles are in the form of an elongated bolt. The lead trolley 41 has a wheel 51 rotatably mounted to axle 49 and supported upon the guide rail 27. The trailing trolley 42 has a primary wheel 52 that is spaced from the primary wheel 51 a distance matching that of the distance between the rail deviation portions 33 and 34. With this spacing the two wheels move into and out of the two deviation portions simultaneously. The trailing trolley 42 also has an auxiliary wheel 53 rotatably mounted to axle 49. The trailing trolley primary wheel 52 is supported upon the guide rail 27 and the auxiliary wheel 53 is supported upon the auxiliary rail 38. A spacer, removed for clarity of illustration, is telescopically positioned over axles 49 between the wheels 51 and 52 of the trolleys and the roller bracket to prevent wheel movement along the axles. The bolt head portion of the axle prevents relative movement of the auxiliary wheel 53 along the axle.

Figure 2:
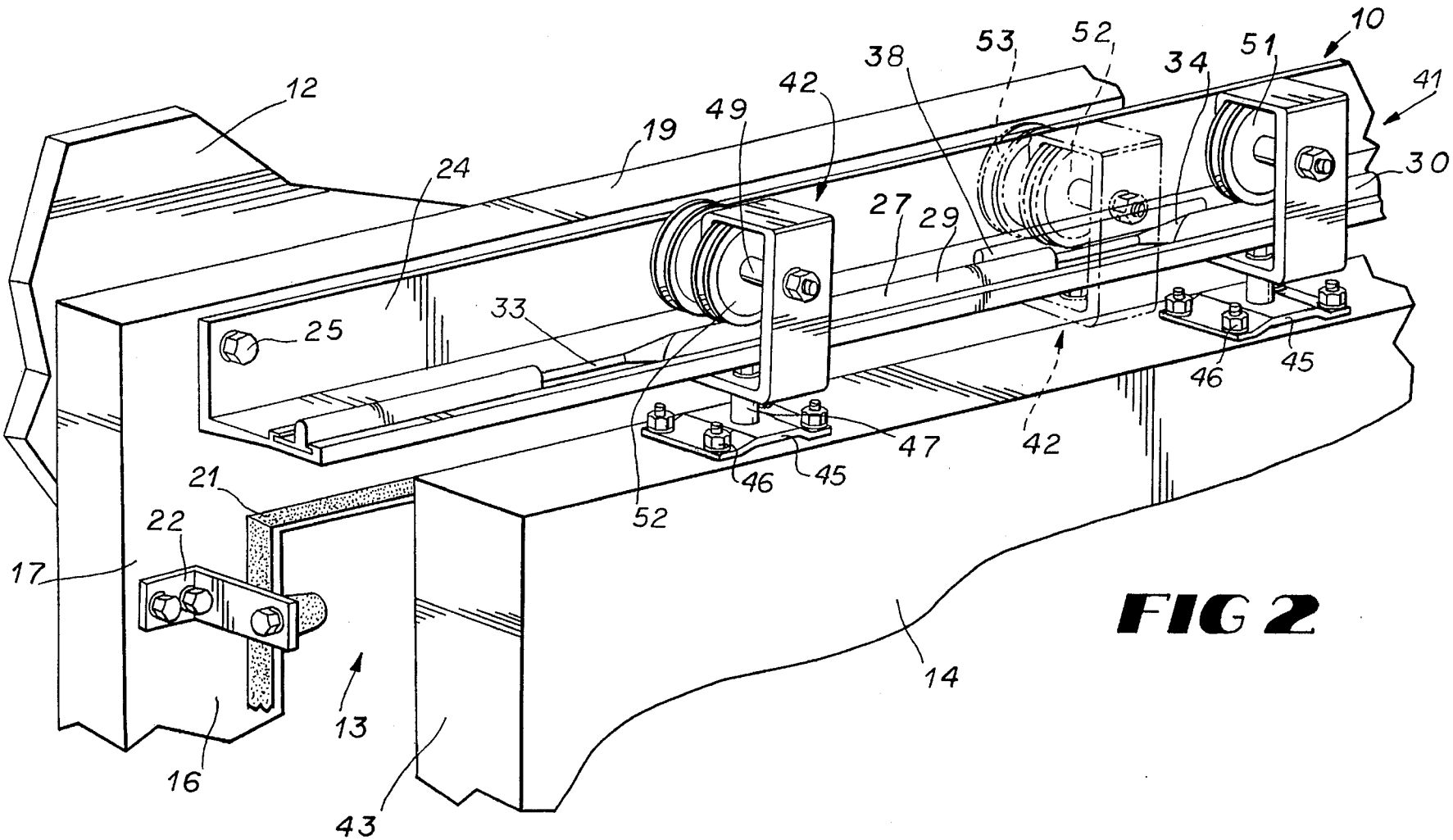
FIG. 2 is a perspective view of a trolley rail system, cooler and cooler door of FIG. 1 shown in a partially open configuration.

In use, the cooler door 14 is slid sideways from a fully open position, exposing the door opening 13, to a closed position sealing the door opening as shown in FIG. 1. Initially, wheel 51 of the leading trolley 41, (here the leading trolley 41 is actually following the trailing trolley 42 as the door is slid in this direction), and the primary wheel 52 of the trailing trolley 42 ride upon linear rail segment 30. As the trolley 42 approaches deviation ramp portion 34 its auxiliary wheel is brought into riding engagement with the auxiliary rail 38. In this manner trolley 42 continues to support the cooler door in sliding, linear travel and to prevent the primary wheel 52 from following ramp portion 34, as shown in phantom lines in FIG. 2. By preventing the trolley 42 from following ramp portion 34 the cooler door continues along a linear path of travel and is thus prevented from moving downwardly and striking the floor and inwardly against the header.

Once the trailing trolley 42 has moved past ramp portion 34 its auxiliary wheel 53 rides off the auxiliary rail 38 after its primary wheel 52 has reached and begun to be supported upon linear rail segment 29. The door then continues along a linear path with the trailing trolley 42 supported upon linear segment 29 and the leading trolley 41 supported upon linear segment 30. Hence, it should be understood that thus far the cooler door has moved linearly along a plane.

Further movement of the cooler door brings the primary wheel 52 of the trailing trolley 42 to deviation rail portion 33 and wheel 51 of the leading trolley 41 simultaneously to deviation portion 34. To make the angular transition between the linear segments 29 and 30 and the deviation ramp portions 33 and 34 the roller brackets 48 pivot through rotation of the vertical axles 47. The inward and downward final movement of the door against stop 22 brings the door into abutment with the sealing strip 21 mounted to the door jamb and the sealing strip across the bottom of the door into engagement with the floor, all without substantial sliding and rubbing of the strips.

To move the door from its closed position to a fully open position the door is forced in an opposite direction to that just described. Initially the door must be driven with enough force to push the trolleys up the two deviation ramp portions. This movement of the trolleys up the ramp portions causes the door to move away from the door jamb and floor. The cooler door is then linearly moved back along its plane of travel through movement of the trolleys upon the linear segments. Once again the trailing trolley is prevented from following deviation ramp portion 34 by being briefly supported by auxiliary wheel 53 upon the auxiliary rail 38.

It should be understood that system 10 may also be used with coolers having two sliding doors which move in opposite directions towards and away from each other. These types of doors also move inward and downward immediately prior to abutting each other in their fully closed position. Also, mechanical driving means such as an electric motor may be coupled to the door to drive it open and closed.

It should also be understood that although the primary wheel and the auxiliary wheel of the trailing trolley are mounted to a common axle they may also be mounted to separate axles both axially and laterally spaced apart. Should the wheels be mounted to separate axles a third trolley may be incorporated to support the additional axle, if desired. The wheels may also be mounted so as to be both supported upon the primary wheel and spaced from each other so that at least one wheel is in contact with the rail at all times. Also, the auxiliary rail may be mounted alongside the primary rail so long as the spacial relation between the auxiliary rail and the auxiliary wheel is such that the auxiliary wheel is disengaged from the auxiliary rail as the primary wheel of the trailing trolley is supported upon the deviation ramp portion 33 and the wheel of the leading trolley is supported upon the deviation ramp portion 34.

From the foregoing it is seen that a trolley rail system for supporting and guiding a sliding door between a closed position and an open position is now provided which overcomes problems associated with those of the prior art. It should be understood however that the just described embodiment merely illustrates principles of the invention in its preferred form. Many modifications, additions and deletions may be made thereto without departure from the spirit and scope of the invention as set forth in the following claims.

What is claimed is:

1. A trolley rail system for supporting and guiding a sliding door between closed and open positions substantially closing and opening a door opening framed by a door jamb and with the trolley rail system comprising, in combination, (a) a primary rail having at least two substantially linear portions that straddle a deviation portion mounted to the door jamb above the door opening;

(b) an auxiliary rail mounted to the door jamb above the door opening generally parallel with said primary rail adjacent said deviation portion; and (c) two trolleys mounted to the door with each trolley having a primary wheel and with one of said trolleys having an auxiliary wheel axially spaced from said one trolley primary wheel a distance for movement on said auxiliary rail as said one trolley primary wheel traverses said primary rail deviation portion to elevate and prevent said one trolley primary wheel from rolling along said primary rail deviation portion.

2. The trolley rail system of claim 1 wherein said one trolley primary wheel and said auxiliary wheel are mounted coaxially.

3. A trolley rail system for supporting and guiding a sliding door between a closed position closely adjacent a side of a doorway and an open position spaced from the doorway side, and with the trolley rail system comprising a primary rail mounted substantially horizontally above the doorway, said primary rail having substantially linear portions, a distal ramp portion located distally from the doorway side and positioned angularly to said linear portions, and a proximal ramp portion located adjacent the doorway side and positioned angularly to said linear portions; an auxiliary rail mounted substantially parallel to said primary rail linear portions; a proximal trolley mounted to the door proximally from the doorway side and having a primary wheel mounted aligned for movement along one of said primary rail linear portions and an auxiliary wheel aligned for movement upon said auxiliary rail; and a distal trolley mounted to the door distally from the doorway side and having a wheel aligned for movement upon a primary rail linear portion whereby the door may be sealed and unsealed by movement of the primary wheel of the proximal trolley along the proximal ramp portion and movement of the distal trolley wheel along the distal ramp portion, and whereby the door is moved between its closed position and its open position with the auxiliary wheel of the proximal trolley supporting the door upon the auxiliary rail as the primary wheel of the proximal trolley passes over the distal ramp portion of the primary rail.

4. The trolley rail system of claim 3 wherein said proximal trolley primary wheel and said proximal trolley auxiliary wheel are mounted coaxially.

5. The trolley rail system of claim 3 wherein said proximal ramp portion and said distal ramp portion are generally parallel.

6. The trolley rail system of claim 3 wherein said auxiliary rail is mounted beside said distal ramp portion.

7. The trolley rail system of claim 3 wherein said linear portion is comprised of two linearly aligned linear segments.

8. A trolley rail system comprising a primary rail having at least two substantially linear portions mounted in linear alignment above a door opening and a deviation portion mounted above the door opening; an auxiliary rail mounted above the door opening parallel with said primary rail linear portions; and trolley means for suspending a door for travel beneath said primary and auxiliary rails, and with said trolley means having two primary wheels rollably mounted upon said primary rail and an auxiliary wheel mounted aligned for movement onto and off of said auxiliary rail as one of said primary wheels passes over said deviation portion of said primary rail.

9. The trolley rail system of claim 8 wherein said trolley means comprises two trolleys, and wherein one said trolley includes one said primary wheel and said auxiliary wheel.

10. The trolley rail system of claim 9 wherein said one primary wheel and said auxiliary wheel are axially spaced from each other.

11. The trolley rail system of claim 10 wherein said one primary wheel and said auxiliary wheel are mounted coaxially.

* * * * *